US006920925B2

(12) United States Patent
Duhn et al.

(10) Patent No.: US 6,920,925 B2
(45) Date of Patent: Jul. 26, 2005

(54) WELLHEAD ISOLATION TOOL

(75) Inventors: Rex E. Duhn, Bakersfield, CA (US); Robert K. Meek, Bakersfield, CA (US)

(73) Assignee: Duhn Oil Tool, Inc., Bakersfield, CA (US)

( * ) Notice: Subject to any disclaimer, the term of this patent is extended or adjusted under 35 U.S.C. 154(b) by 0 days.

(21) Appl. No.: 10/369,070

(22) Filed: Feb. 19, 2003

(65) Prior Publication Data

US 2003/0221823 A1 Dec. 4, 2003

Related U.S. Application Data

(60) Provisional application No. 60/357,939, filed on Feb. 19, 2002.

(51) Int. Cl.[7] ..... E21B 33/03

(52) U.S. Cl. ..... 166/75.13; 166/75.14; 166/96.1; 166/93.1; 166/379

(58) Field of Search ..... 166/75.13, 75.14, 166/379, 96.1, 93.1

(56) References Cited

U.S. PATENT DOCUMENTS 3,166,125 A * 1/1965 Hubby ..... 166/67
4,241,786 A 12/1980 Bullen
4,867,243 A 9/1989 Garner et al.
4,991,650 A 2/1991 McLeod (Continued)

OTHER PUBLICATIONS

Cooper–Cameron 2002–2003 General Catalog, Mar. 2002, see Surface Systems Section.*

GUARDIAN, Casing & Tree Savers, 2000, 7 pages.

*Primary Examiner*—David Bagnell
*Assistant Examiner*—Shane Bomar
(74) *Attorney, Agent, or Firm*—Christie, Parker & Hale, LLP

(57) ABSTRACT

A wellhead isolation tool and a wellhead assembly incorporating such a tool are provided. The wellhead assembly has an annular assembly coupled to a well. The annular assembly may include a casing head coupled to the well and a tubing head mounted over the casing head. The wellhead isolation tool is suspended in the annular assembly. The wellhead isolation tool has a first end portion extending above the annular assembly and a second end portion below the first end portion within the annular assembly. A production casing suspended in the annular assembly and is aligned with the wellhead isolation tool.

88 Claims, 7 Drawing Sheets

U.S. PATENT DOCUMENTS 4,993,489 A 2/1991 McLeod
5,060,723 A 10/1991 Sutherland et al.
5,103,900 A 4/1992 McLeod et al.
5,143,158 A * 9/1992 Watkins et al. ..... 166/344
5,236,037 A 8/1993 Watkins
5,285,852 A 2/1994 McLeod
5,289,882 A * 3/1994 Moore ..... 166/379
5,372,202 A 12/1994 Dallas
5,490,565 A 2/1996 Baker
5,540,282 A 7/1996 Dallas
5,605,194 A 2/1997 Smith
5,819,851 A 10/1998 Dallas
5,927,403 A 7/1999 Dallas
5,975,211 A 11/1999 Harris
6,039,120 A 3/2000 Wilkins et al.
6,092,596 A * 7/2000 Van Bilderbeek ..... 166/89.1
6,179,053 B1 1/2001 Dallas
6,196,323 B1 3/2001 Moksvold
6,199,914 B1 3/2001 Duhn
6,220,363 B1 4/2001 Dallas
6,260,624 B1 7/2001 Pallini, Jr. et al.
6,289,993 B1 9/2001 Dallas
6,360,822 B1 3/2002 Robertson
6,364,024 B1 4/2002 Dallas
6,516,861 B2 2/2003 Allen
6,688,386 B2 * 2/2004 Cornelssen et al. ..... 166/65.1
6,712,147 B2 * 3/2004 Dallas ..... 166/379
2002/0062964 A1 5/2002 Allen
2002/0100592 A1 8/2002 Garrett et al.
2002/0117298 A1 8/2002 Wong et al.
2002/0125005 A1 9/2002 Eslinger et al.
2002/0185276 A1 12/2002 Muller et al.
2002/0195248 A1 12/2002 Ingram et al.
2003/0000693 A1 1/2003 Couren et al.
2003/0019628 A1 1/2003 Ravensbergen et al.
2003/0024709 A1 2/2003 Cuppen

* cited by examiner

WELLHEAD ISOLATION TOOL

CROSS-REFERENCED TO RELATED APPLICATION

This application claims priority and is based upon Provisional Application No. 60/357,939, filed on Feb. 19, 2002, the contents of which are fully incorporated herein by reference.

BACKGROUND OF THE INVENTION

The present invention relates to wellhead equipment, and to a wellhead tool for isolating wellhead equipment from the extreme pressures and abrasive materials used in oil and gas well stimulation.

Oil and gas wells often require remedial actions in order to enhance production of hydrocarbons from the producing zones of subterranean formations. These actions include a process called fracturing whereby fluids are pumped into the formation at high pressures in order to break up the product bearing zone. This is done to increase the flow of the product to the well bore where it is collected and retrieved. Abrasive materials, such as sand or bauxite, called propates are also pumped into the fractures created in the formation to prop the fractures open allowing an increase in product flow. These procedures are a normal part of placing a new well into production and are common in older wells as the formation near the well bore begins to dry up. These procedures may also be required in older wells that tend to collapse in the subterranean zone as product is depleted in order to maintain open flow paths to the well bore.

The surface wellhead equipment is usually rated to handle the anticipated pressures that might be produced by the well when it first enters production. However, the pressures encountered during the fracturing process are normally considerably higher than those of the producing well. For the sake of economy, it is desirable to have equipment on the well rated for the normal pressures to be encountered. In order to safely fracture the well then, a means must be provided whereby the elevated pressures are safely contained and means must also be provided to control the well pressures. It is common in the industry to accomplish these requirements by using a 'stinger' that is rated for the pressures to be encountered. The 'stinger' reaches through the wellhead and into the tubing or casing through which the fracturing process is to be communicated to the producing subterranean zone. The 'stinger' also commonly extends through a blow out preventer (BOP) that has been placed on the top of the wellhead to control well pressures. Therefore, the 'stinger', by its nature, has a reduced bore which typically restricts the flow into the well during the fracturing process. Additionally, the placement of the BOP on the wellhead requires substantial ancillary equipment due to its size and weight.

It would, therefore, be desirable to have a product which does not restrict the flow into a well during fracturing and a method of fracturing whereby fracturing may be safely performed, the wellhead equipment can be protected from excessive pressures and abrasives and the unwieldy BOP equipment can be eliminated without requiring the expense of upgrading the pressure rating of the wellhead equipment. It would also be desirable to maintain an upper profile within the wellhead that would allow the use of standard equipment for the suspension of production tubulars upon final completion of the well.

SUMMARY OF THE INVENTION

The present invention is directed to a wellhead isolation tool and to a wellhead assembly incorporating the same. The present invention in an exemplary embodiment provides for a wellhead isolation tool, also referred to as a "frac mandrel" that cooperates with a relatively low pressure wellhead to accommodate the elevated pressures encountered during the fracturing process by taking advantage of the heavier material cross-section present in the lower end of wellhead equipment and by isolating the weaker upper portions of the wellhead from high fracturing pressures. Said tool provides a full diameter access into the well bore, thus enhancing the fracturing process, and may be used with common high pressure valves to provide well pressure control. The invention further provides for retention of standard profiles within the upper portion of the wellhead allowing the use of standard tubing hangers to support production tubing within the completed well.

In an exemplary embodiment of the invention, a wellhead device is provided that is operable with a conventional high pressure valve for controlling well pressure having at least one string of tubulars. The wellhead device consists of a wellhead body member and a cooperating wellhead isolation tool.

A wellhead body member is provided with an internal through bore communicating with the upper end of a string of tubulars. The lower end of the wellhead body member may be provided with a means to threadedly engage the tubulars, be welded to the tubulars, or slipped over the tubulars and otherwise sealed. The upper end of wellhead body member may be provided with a flanged connection or otherwise furnished with an alternative means of connecting completion equipment, and is further provided with an internal through bore preparation, known in the art as a bowl, to allow suspension of production tubulars. An intermediate connection or connections, either threaded or studded flange, is provided within the wall of the wellhead body member affecting a transverse access port to the annular area between the wellhead body member and the production tubulars. A through bore preparation of the wellhead body member is provided between the transverse access port and lower end tubular accommodation that cooperates with lower end and seals of the wellhead isolation tool. The upper flanged end of the wellhead body member is provided with a plurality of radial threaded ports. Said radial ports are provided with cooperating threaded devices, commonly referred to as lock screws, for the purpose of retaining equipment within the upper bowl of the wellhead body member. The quantity of these lock screws is determined by the pressure rating of the wellhead body member in combination with other parameters.

The exemplary embodiment wellhead isolation tool, is provided with a through bore that equals the through bore of the wellhead tubulars, thus maximizing flow characteristics through the tool. The upper end of the wellhead isolation tool is provided with a flange rated to accommodate fracturing pressures and suitable for the installation of equipment pertinent to the fracturing process. The outer surface of the lower end of wellhead isolation tool cooperates with the lower bore preparation of the wellhead body member and is equipped with a pair of seals that provide isolation of the through bore of the wellhead isolation tool from the upper bore area of the wellhead body member. A radial threaded port is provided in the wall of the wellhead body member in such a location as to provide a means to test the effectiveness of the isolation seals of the wellhead isolation tool after it is installed in the wellhead body member.

In a first exemplary embodiment, the mediate portion of the wellhead isolation tool is provided with an external profile that cooperates with the upper bowl profile of the wellhead body member to establish the proper vertical positioning of the wellhead isolation tool. The outside periphery of this embodiment of the wellhead isolation tool is provided with a pair of grooves formed in the shape of a truncated "V". The resulting lower conic surface of the lowermost "V" groove cooperates with frustroconical ends of the lock screws when the lock screws are threaded into place through their cooperating ports in the flange of the upper end of the wellhead body member to affect retention of the wellhead isolation tool within the wellhead body member. In order to provide the additional strength required to adequately retain the wellhead isolation tool within the wellhead body member, an additional flange, known in the art as a secondary tie down flange, is provided that cooperates with the upper flange of the wellhead body member by a plurality of bolts or studs installed through matching holes machined in the flanges. This additional flange is also provided with a plurality of radial threaded ports in which cooperating lock screws are installed to provide additional retention capacity of the wellhead isolation tool. The frustroconical ends of the latter lock screws cooperate with the lower conic surface of the uppermost "V" groove provided in the wellhead isolation tool to provide the additional strength required to adequately retain the wellhead isolation tool within the wellhead body member. It will be recognized that the additional flange could be furnished as an integral part of the wellhead isolation tool.

In another exemplary embodiment of the wellhead isolation tool, the mediate portion of the tool is provided with an external profile that acts independently from the upper bowl profile of the wellhead body member and with a mounting flange that is threadedly connected to the wellhead solation tool. This allows the wellhead isolation tool to be more universal in its application. The lower end configuration of the second version of the wellhead isolation tool is the same as in the first exemplary embodiment and seals within the cooperating bore of the wellhead body member. As in the first exemplary embodiment, the mounting flange may be provided as an integral part of the wellhead isolation tool.

In another exemplary embodiment of the wellhead isolation tool of the present invention, the wellhead isolation tool penetrates a tubing head and a mandrel casing hanger which is seated within a casing head. A portion of the tubing head also penetrates the mandrel casing hanger. A latch and a top nut are used to retain mandrel casing hanger in the tubing head. The wellhead isolation tool seals at its lower end against the mandrel casing hanger.

In yet a further exemplary embodiment, the wellhead isolation tool penetrates a combination tubing head/casing head and seals against a casing hanger which is seated within the tubing head/casing head combination. The casing hanger is retained within the tubing head/casing head combination by a latch and a top nut. The wellhead isolation tool seals at its lower end against the casing hanger. The top nut used with any of the aforementioned embodiments can have an expanded upper portion for the landing of additional wellhead equipment.

These and other features and advantages will be become apparent from the appended drawings and detailed description.

DESCRIPTION OF EXEMPLARY EMBODIMENTS OF THE INVENTION

Figure 1:
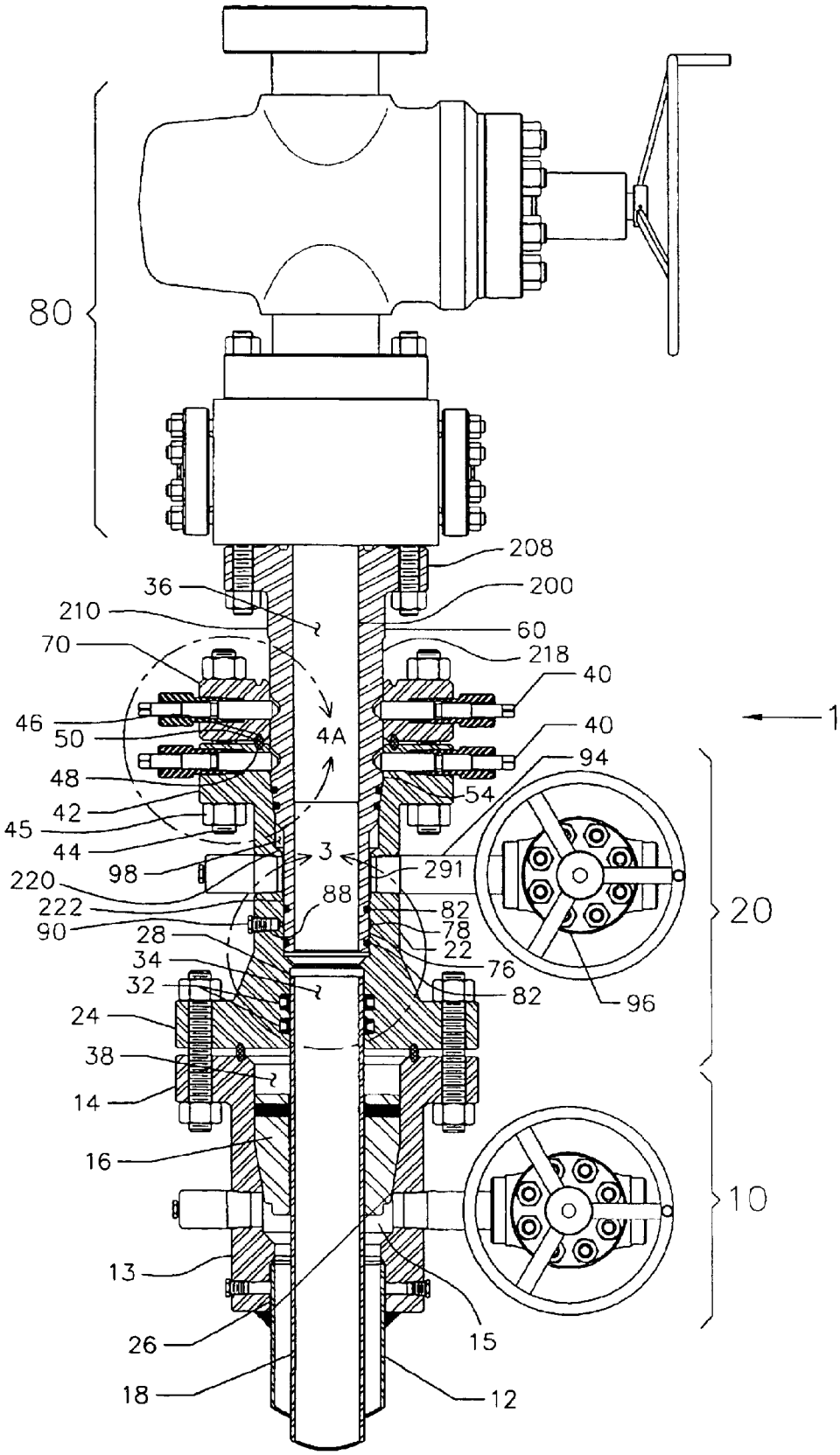
FIG. 1 is a partial cross-sectional view of a typical wellhead with an exemplary embodiment wellhead isolation tool of the present invention and a fracturing tree assembly.

Referring now to the drawings and, particularly, to FIG. 1, a representation of an exemplary embodiment wellhead assembly 1 of the present invention is illustrated. The exemplary embodiment wellhead assembly 1 includes a lower housing assembly 10 also referred to herein as a casing head assembly; an upper assembly 80 also referred to herein as a fracturing tree; an intermediate body member assembly 20 also referred to herein as a tubing head assembly; and a wellhead isolation tool or member 60, which is an elongate annular member, also referred to herein as a frac mandrel. It will be recognized by those skilled in the art that there may be differing configurations of wellhead assembly 1. The casing head assembly includes a casing head 13 defining a well bore 15. The lower end 26 of casing head 13 is connected and sealed to surface casing 12 either by a welded connection as shown or by other means such as a threaded connection (not shown).

The tubing head assembly 20 includes a body member referred to herein as the "tubing head" 22. The upper end 14 of casing head 13 cooperates with a lower end 24 of body member 22 whether by a flanged connection as shown or by other means. A production casing 18 is suspended within the well bore 15 by hanger 16. The upper end of production casing 18 extends into the body member and cooperates with the lower bore preparation 28 of body member 22. The juncture of production casing 18 and lower bore preparation 28 is sealed by seals 32. The seals 32 which may be standard or specially molded seals. In an exemplary embodiment, the seals are self energizing seals such as for example O-ring, T-seal or S-seal types of seals. Self-energizing seals do not need excessive mechanical forces for forming a seal.

Figure 3:
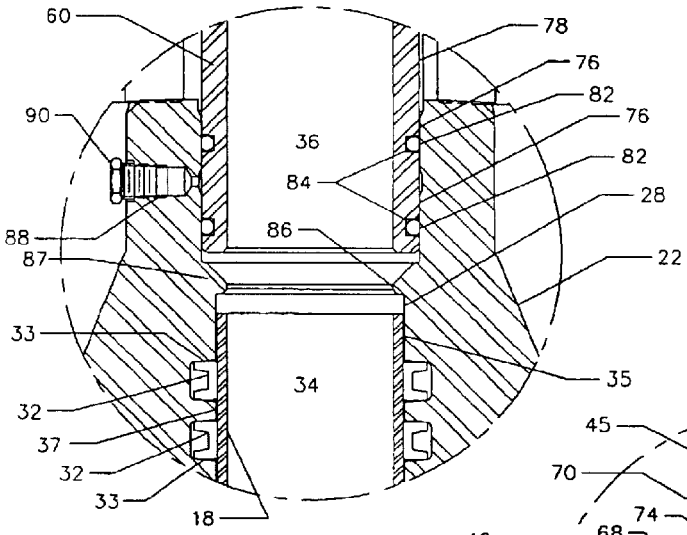
FIG. 3 is an enlarged cross-sectional view encircled by arrow 3—3 in FIG. 1.

Grooves 33 may be formed on the inner surface 35 of the body member 22 to accommodate the seals 32, as shown in FIG. 3, so that the seals seal against an outer surface 37 of the production casing 18 and the grooves 33. In this regard, the seals 32 prevent the communication of pressure contained within the production casing inner bore 34 to the cavity 38 defined in the upper portion of the well bore 15 of the casing head 13. In an alternative exemplary embodiment not shown, grooves may be formed on the outer surface 37 of the production casing 18 to accommodate the seals 32. With this embodiment, the seals seal against the inner surface 35 of the body member. In further alternate exemplary embodiments, other seals or methods of sealing may be used to prevent the communication of pressure contained within the production casing inner bore 34 to cavity 38 defined in the upper portion of the well bore 15 of the casing head 13.

It will be recognized by those skilled in the art that the production casing 18 may also be threadedly suspended within the casing head 13 by what is known in the art as an extended neck mandrel hanger (not shown) whereby the extended neck of said mandrel hanger cooperates with the lower cylindrical bore preparation 28 of body member 22 in same manner as the upper end of production casing 18 and whose juncture with lower cylindrical bore preparation 28 of body member 22 is sealed in the same manner as previously described.

In the exemplary embodiment shown in FIG. 1, the body member 22 includes an upper flange 42. A secondary flange 70 is installed on the upper flange 42 of body member utilizing a plurality of studs 44 and nuts 45. A spacer 50 cooperates with a groove 46 in secondary flange 70 and a groove 48 in the upper flange 42 of body member 22 in order to maintain concentricity between secondary flange 70 and upper flange 42.

Figure 4A:
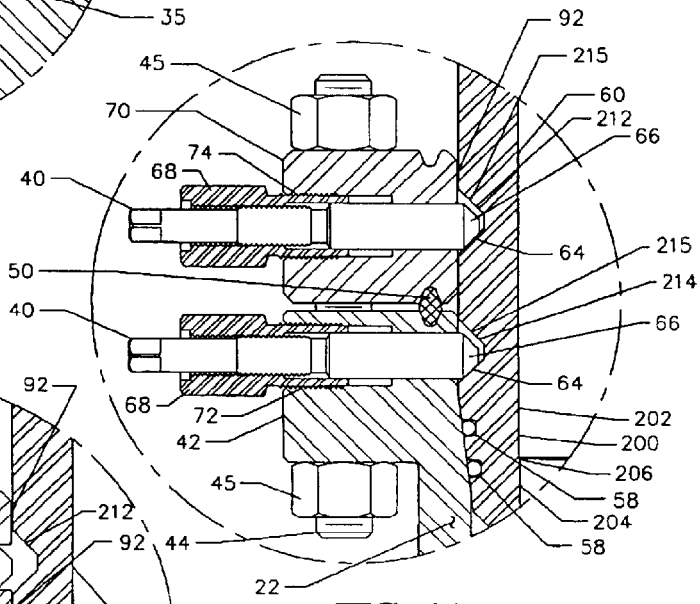
FIG. 4A is an enlarged cross-sectional view encircled by arrow 4A—4A in FIG. 1.
Figure 4B:
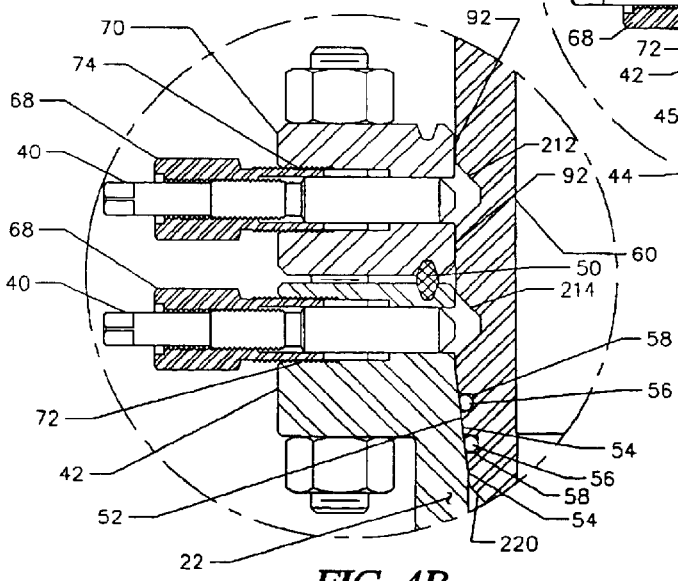
FIG. 4B is the same view as FIG. 4A with the cooperating lock screws shown in a retracted position.

Now referring to FIGS. 4A and 4B, lock screws 40 having frustum-conical ends 66 threadedly cooperate with retainer nuts 68 which, in turn, threadedly cooperate with radial threaded ports 72 in upper flange 42 of body member 22 and radial threaded ports 74 in secondary flange 70. The lock screws 40 may be threadedly retracted to allow unrestricted access through bore 92 defined through the secondary flange 70 as for example shown in FIG. 4B.

With the lock screw retracted, an exemplary embodiment wellhead isolation tool 60 is installed through cylindrical bore 92 in secondary flange 70 and into the body member 22. The exemplary embodiment wellhead isolation tool shown in FIG. 1 is a generally elongated annular member having an inner surface 200 having a first section 202 having a first diameter and a second section 204 extending below the first section and having diameter smaller than that of the first section (FIG. 4A). Consequently, a shoulder 206 is defined between the two sections as for example shown in FIG. 4A.

A radial flange 208 extends from an upper end of the wellhead isolation tool and provides an interface for connecting the upper assembly or fracturing tree 80 as shown in FIG. 1. A first annular groove 212 is formed over a second annular groove 214 on an outer surface 210 of the wellhead isolation tool, as for example shown in FIGS. 4A and 4B. In cross-section the grooves are frustum-conical, i.e, they have an upper tapering surface 215 and a lower tapering surface 64 as shown in FIG. 4B. In an alternate embodiments, instead of the grooves 212, 214, a first set of depressions (not shown) is formed over as second set of depressions (not shown) on the outer surface of the wellhead isolation tool. Each set of depressions is radially arranged around the outer surface of the wellhead isolation tool. These depressions also have a frustum-conical cross-sectional shape.

The outer surface 210 of the well head isolation tool has an upper tapering portion 54 tapering from a larger diameter upper portion 218 to a smaller diameter lower portion 222. A lower tapering portion 220 extends below the upper tapering portion 54, tapering the outer surface of the wellhead isolation tool to a smaller diameter lower portion 222.

When the wellhead isolation tool is fitted into the body member through the secondary flange 70, the upper outer surface tapering portion 54 of the wellhead isolation tool mates with a complementary tapering inner surface portion 52 of the body member 22 as shown in FIG. 4B. A seal is provided between the wellhead isolation tool and the body member 22. The seal may be provided using seals 56, as for example self energizing seals such as for example O-ring, T-seal and S-seal type seals fitted in grooves 58 formed on the upper tapering portion 54 of the outer surface of the wellhead isolation tool. In an alternate embodiment not shown, the seals are fitted in grooves on the tapering inner surface portion of the body member. When the upper outer surface tapering portion of the wellhead isolation tool is mated with the tapering inner surface portion of the body member, the lock screws 40 penetrating the secondary flange 70 are aligned with the upper groove 212 formed on the wellhead isolation tool outer surface and the lock screws 40 penetrating the upper flange 42 of the body member 22 are aligned with lower groove 214 formed on the outer surface of the wellhead isolation tool. In an alternate embodiment, the mandrel may have to be rotated such that the lock screws 40 penetrating the secondary flange are aligned with a first set of depressions (not shown) formed on the wellhead isolation tool outer surface and the lock screws 40 penetrating the upper flange of the body member 22 are aligned with a second set depressions (not shown) formed on the outer surface of the wellhead isolation tool.

Now referring to FIG. 4A, lock screws 40 are threadedly inserted so that their frustum conical ends 66 engage the lower tapering surfaces 64 of their respective grooves 212, 214 formed on the outer surface of the exemplary wellhead isolation too). 60 thereby, retaining the wellhead isolation tool 60 within body member 22. With this embodiment, excess loads on the wellhead isolation tool 60 not absorbed by lock screws 40 installed in upper flange 42 are absorbed by lock screws 40 installed in secondary flange 70 and redistributed through studs 44 and nuts 45 to upper flange 42.

Now referring to FIG. 3, with the wellhead isolation tool 60 installed in the body member 22, the outer cylindrical surface 78 of the wellhead isolation tool lower portion 222 cooperates with inner surface 76 of the body member 22. Seals 82 are installed in grooves 84 formed in outer surface 78 of the wellhead isolation tool and cooperate with surfaces 76 to effect a seal between the body member 22 and the wellhead isolation tool 60. In an exemplary embodiment, the seals are self energizing seals such as for example O-ring, T-seal or S-seal types of seals. Alternatively, the seals may be fitted in the grooves formed on in the inner surface 76 of the body member. Pipe port 88 is radially formed through body member 22 and provides access for testing seals 82 prior to placing the wellhead isolation tool 60 in service. Subsequent to testing, pipe port 88 is sealed in an exemplary embodiment with pipe plug 90. Testing may be accomplished by applying air pressure through the pipe port 88 and monitoring the pressure for a decrease. A decrease in pressure of a predetermined amount over a predetermined time period may be indicative of seal leakage.

Cylindrical bores 34, 36 and 86 defined through the production casing 18, the exemplary embodiment wellhead isolation tool 60, and through an annular lip portion 87 the body member 22, respectively, are in an exemplary embodiment as shown in FIG. 3 equal in diameter thus providing an unrestricted passageway for fracturing materials and/or downhole tools.

Referring again to FIG. 1, valve 96 is connected to body member 22 by pipe nipple 94. Valve 96 may also be connected to the body member 22 by a flanged or studded outlet preparation. Valve 96 may then be opened during the fracturing process to bleed high pressures from cavity 98 in the event of leakage past seals 82.

Figure 2:
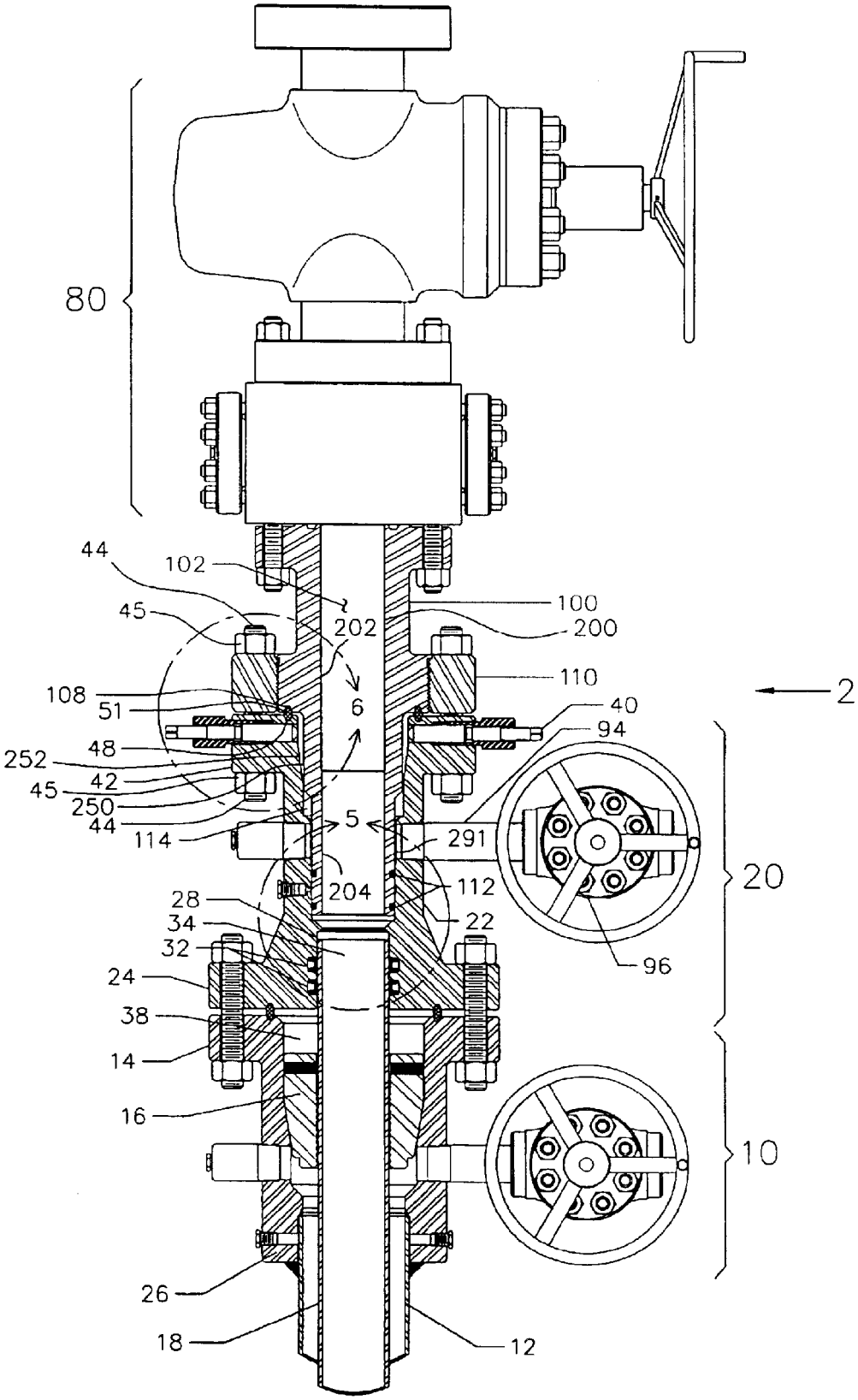
FIG. 2 is a partial cross-sectional view of a typical wellhead with another exemplary embodiment wellhead isolation tool of the present invention and a fracturing tree assembly.

FIG. 2 shows another exemplary embodiment wellhead assembly 2 consisting of a lower housing assembly 10 also referred to herein as a casing head assembly; an upper assembly 80 also referred to herein as a fracturing tree; an intermediate body member assembly 20 also referred to herein as a body member assembly; and another exemplary embodiment wellhead isolation tool 100 also referred to herein as a wellhead isolation tool. It will be recognized by those practiced in the art that there may be differing configurations of wellhead assembly 2. Since the exemplary embodiment shown in FIG. 2 incorporates many of the same elements as the exemplary embodiment shown in FIG. 1, the same references numerals are used in both figures for the same elements. For convenience only the differences from the exemplary embodiment shown in FIG. 1 are described for illustrating the exemplary embodiment of FIG. 2.

Figure 6:
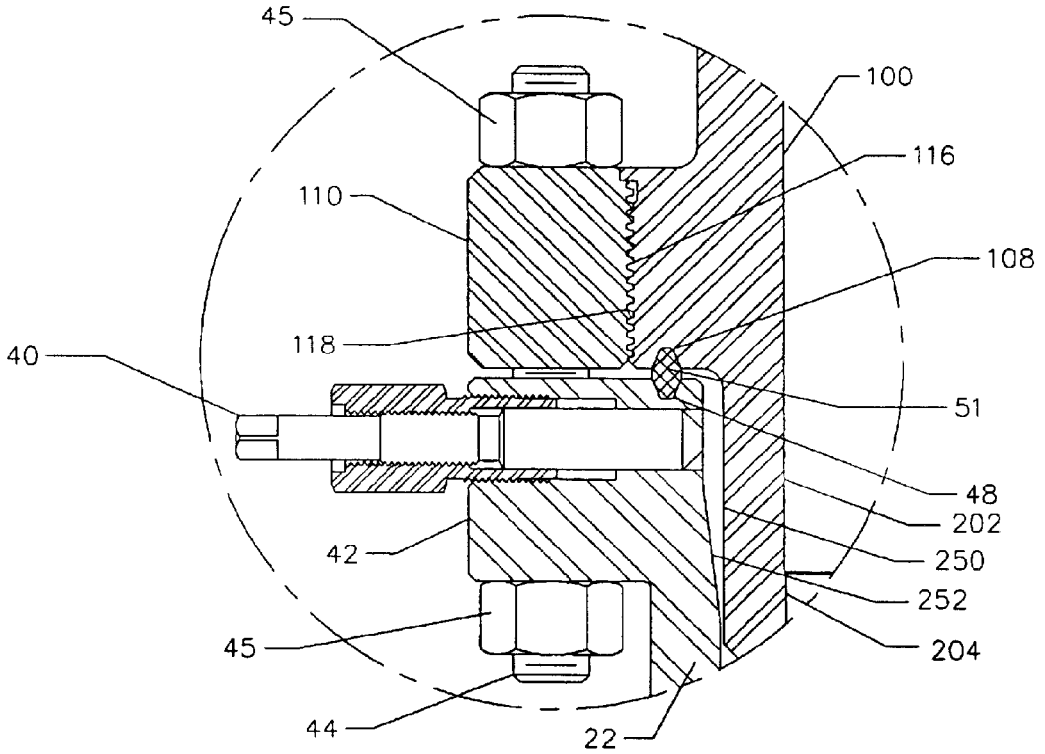
FIG. 6 is an enlarged cross-sectional view of the section encircled by arrow 6—6 in FIG. 2.

Now referring to FIG. 6, a secondary flange 110 is provided in an exemplary embodiment with threads 118, preferably ACME threads, on its inner cylindrical surface that cooperate with threads 116, also in an exemplary embodiment preferably ACME, on the outer cylindrical surface of wellhead isolation tool 100. In an alternate exemplary embodiment, secondary flange 110 may be incorporated as an integral part of wellhead isolation tool 100. However, the assembled tool may be produced more economically with a threaded on secondary flange 110 as for example shown in FIG. 6. The assembly of secondary flange 110 and wellhead isolation tool 100 is coupled to on the upper flange 42 of body member 22 utilizing a plurality of studs 44 and nuts 45. A standard sealing gasket 51 cooperates with a groove 108 formed in the wellhead isolation tool 100 and groove 48 in the upper flange 42 of body member 22 in order to maintain concentricity and a seal between wellhead isolation tool 100 and upper flange 42. With this embodiment, excess loads on the wellhead isolation tool 100 are transmitted to the flange 110 and redistributed through studs 44 and nuts 45 to upper flange 42.

Figure 5:
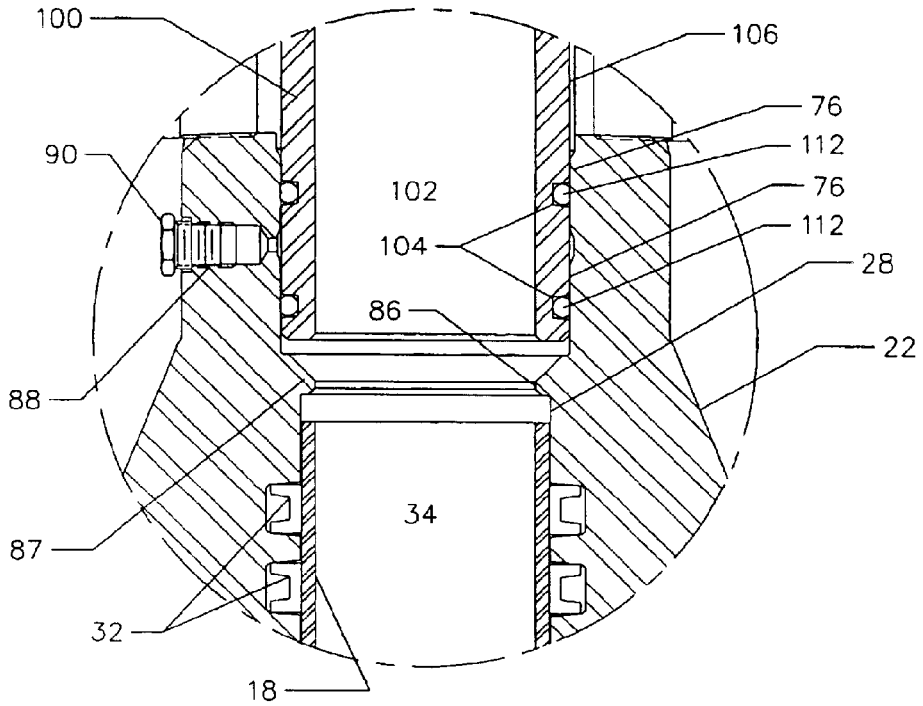
FIG. 5 is an enlarged cross-sectional view of the section encircled by arrow 5—5 in FIG. 2.

Now referring to FIG. 5, with the wellhead isolation tool 100 installed in body member 22, outer surface 106 of wellhead isolation tool 100 cooperates with cylindrical bore surface 76 of body member 22. Seals 112 installed in grooves 104 machined in outer surface 106 of wellhead isolation tool 100 cooperate with surfaces 76 to effect a seal between body member 22 and wellhead isolation tool 100. Alternatively, the seals are fitted in grooves formed on the inner bore surface 76 of body member 22 and cooperate with the outer surface 106 of the wellhead isolation tool. In the exemplary embodiment, the seals are self energizing seals as for example O-ring, T-seal and S-seal type seals. Other sealing schemes known in the art may also be used in lieu or in combination with the sealing schemes described herein.

As with the embodiment, shown in FIG. 1, pipe port 88 radially formed through body member 22 provides access for testing seals 112 prior to placing wellhead isolation tool 100 in service. Subsequent to testing, pipe port 88 is sealed with pipe plug 90. Cylindrical bores 34, 102 and 86 formed through the production casing 18, through the exemplary embodiment wellhead isolation tool 100, and through the annular lip portion on 87 of the body member 22, respectively, are in an exemplary embodiment equal in diameter thus providing an unrestricted passageway for fracturing materials and/or downhole tools.

Referring again to FIG. 2, valve 96 is connected to body member 22 by pipe nipple 94. Alternatively, the valve 96 may also be connected to body member 22 by a flanged or studded outlet preparation. Valve 96 may then be opened during the fracturing process to bleed high pressures from cavity 114 in the event of leakage past seals 112.

While the wellhead isolation tool has been described with having an upper tapering portion 54 formed on its outer surface which mates with a complementary tapering inner surface 52 of the body member 22, an alternate exemplary embodiment of the wellhead isolation tool does not have a tapering outer surface mating with the tapering inner surface portion 52 of the body member. With the alternate exemplary embodiment wellhead isolation tool, as for example shown in FIG. 2, the wellhead isolation tool has an outer surface 250 which mates with an inner surface 252 of the body member which extends below the tapering inner surface portion 52 of the body member 22. Features of the exemplary embodiment wellhead isolation tool shown in FIG. 1 can interchanged with features of the exemplary embodiment wellhead isolation tool shown in FIG. 2. For example, instead of being coupled to a threaded secondary flange 110, the exemplary embodiment isolation tool may be coupled to the secondary flange 70 in the way shown in relation to the exemplary embodiment wellhead isolation tool shown in FIG. 1.

With any of the aforementioned embodiments, the diameter of the tubing head inner surface 291 (shown in FIGS. 1 and 2) immediately above the area where the lower portion of the wellhead isolation tool seals against the inner surface head of the tubing head is greater than the diameter of the inner surface of the tubing head against which the wellhead isolation tool seals and is greater than the outer surface diameter of the lower portion of the wellhead isolation tool. In this regard, the wellhead isolation tool with seals 32 can be slid into and seal against the body member of the tubing head assembly without being caught.

Figure 7A:
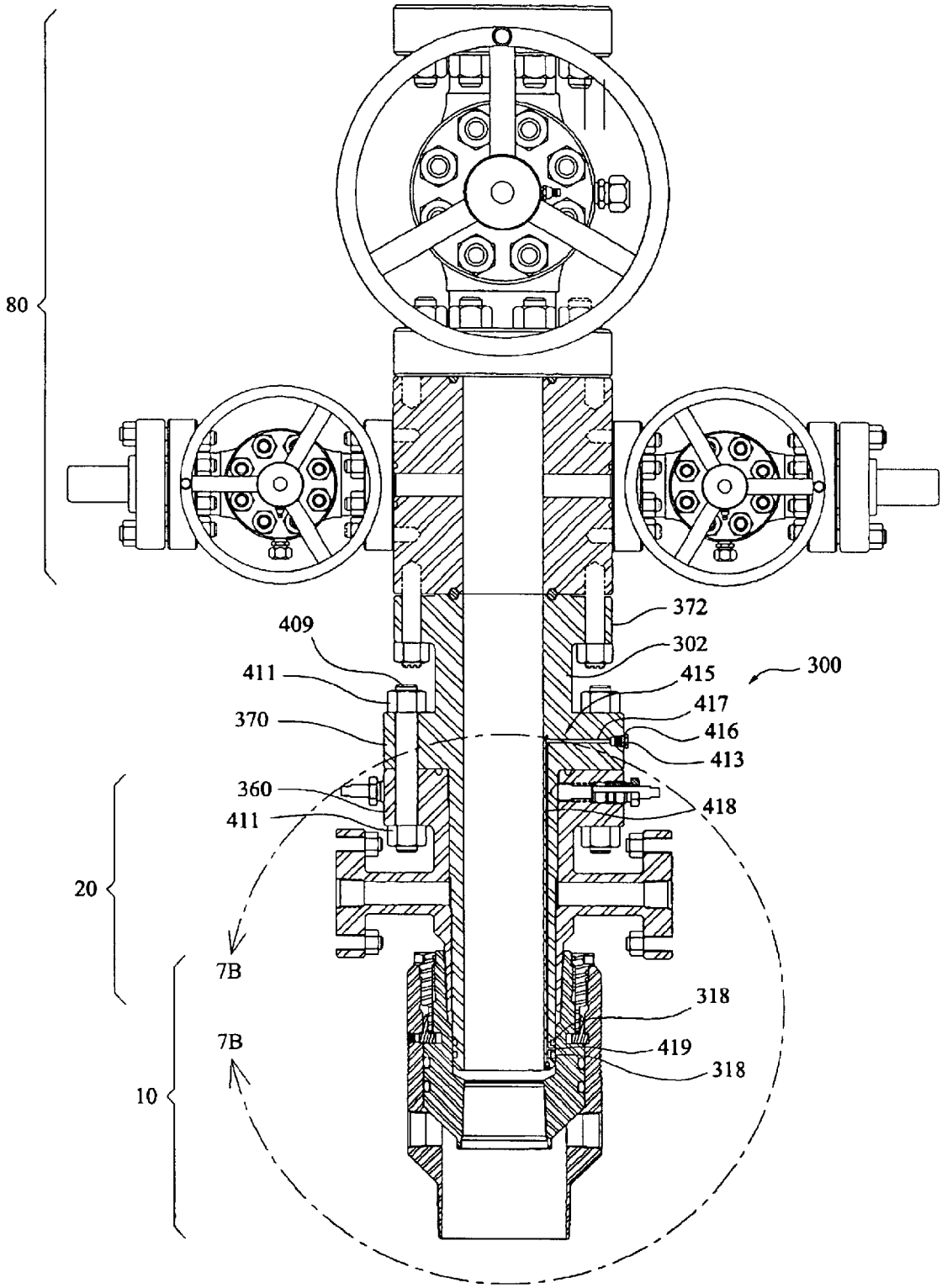
FIG. 7A is a partial cross-sectional view of an exemplary embodiment wellhead incorporating an exemplary embodiment wellhead isolation tool of the present invention.
Figure 7B:
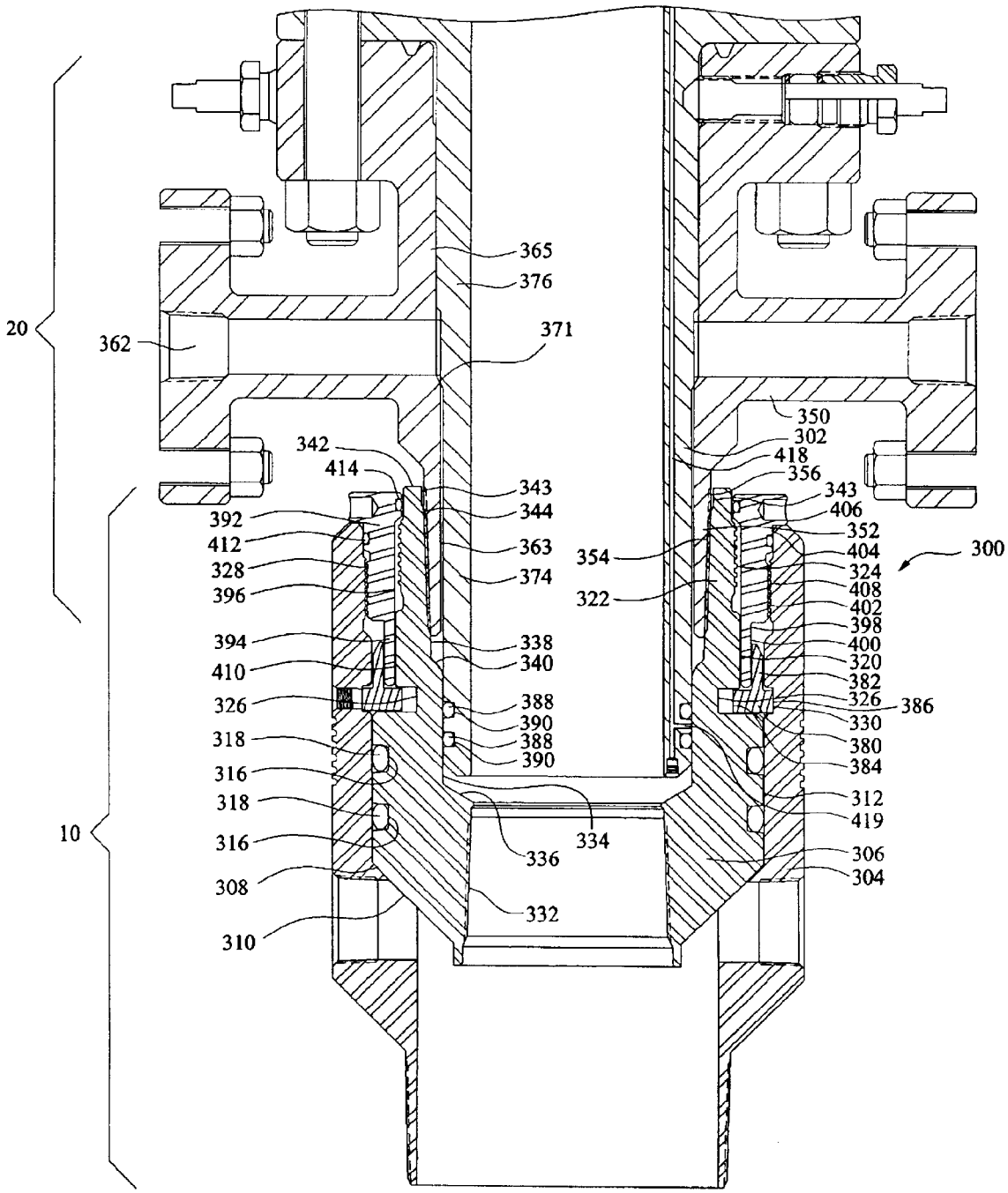
FIG. 7B is an enlarged cross-sectional view of the area encircled by arrow 7B—7B in FIG. 7A.

A further exemplary embodiment assembly 300 comprising a further exemplary embodiment wellhead isolation tool or frac mandrel 302, includes a lower housing assembly 10 also referred to herein as a casing head assembly, an upper assembly 80 also referred to herein as a fracturing tree, and intermediate body assembly 20 also referred to herein as a tubing head assembly, and the intermediate wellhead isolation tool 302 also referred to herein as a frac mandrel, as shown in FIGS.7A and 7B. The casing head assembly includes a casing head 304 into which is seated a mandrel casing hanger 306. The casing head 304 has an internal annular tapering surface 308 on which is seated a complementary outer tapering surface 310 of the mandrel casing hanger. The tapering outer surface 310 of the mandrel casing hanger defines a lower portion of the mandrel casing hanger. Above the tapering outer surface of the mandrel casing hanger extends a first cylindrical outer surface 312 which mates with a cylindrical inner surface of the casing head 304. One or more annular grooves, as for example two annular grooves 316 are defined in the first cylindrical outer surface 312 of the mandrel casing hanger and accommodate seals 318. In the alternative, the grooves may be formed on the inner surface of the casing head port for accommodating the seals.

The mandrel casing hanger 306 has a second cylindrical outer surface 320 extending above the first cylindrical outer surface 312 having a diameter smaller than the diameter of the first cylindrical outer surface. A third cylindrical outer surface 322 extends from the second cylindrical outer surface and has a diameter slightly smaller than the outer surface diameter of the second cylindrical outer surface. External threads 324 may be formed on the outer surface of the third cylindrical surface of the mandrel casing hanger.

An outer annular groove 326 is formed at the juncture between the first and second cylindrical outer surfaces of the mandrel casing hanger. Internal threads 328 are formed at the upper end of the inner surface of the casing head. An annular groove 330 is formed in the inner surface of the mandrel casing head.

The inner surface of the madrel casing hanger has three major sections. A first inner surface section 332 at the lower end which may be a tapering surface, as for example shown in FIG. 7B. A second inner surface 334 extends from the first inner surface section 332. In the exemplary embodiment shown in FIG. 7B, a tapering annular surface 336 adjoins the first inner surface to the second major inner surface. A third inner surface 338 extends from the second inner surface. An annular tapering surface 340 adjoins the third inner surface to the second inner surface. An upper end 342 of the third inner surface of the mandrel casing hanger increases in diameter forming a counterbore 343 and a tapered thread 344.

Body member 350 also known as a tubing head of the tubing head assembly 20 has a lower cylindrical portion 352 having an outer surface which in the exemplary embodiment threadedly cooperates with inner surface 354 of the third inner surface section of the mandrel casing hanger. A protrusion 356 is defined in an upper end of the lower cylindrical section of the body member 350 for mating with the counterbore 343 formed at the upper end of the third inner surface of the mandrel casing hanger. The body member 350 has an upper flange 360 and ports 362. The inner surface of the body member is a generally cylindrical and includes a first section 363 extending to the lower end of the body member. In the exemplary embodiment shown in FIGS. 7A and 7B, the first section extends from the ports 362. A second section 365 extends above the ports 362 and has an outer diameter slightly greater than that of the first section.

The wellhead isolation tool has a first external flange 370 for mating with the flange 360 of the body member of the tubing head assembly. A second flange 372 is formed at the upper end of the wellhead isolation tool for mating with the upper assembly 80. A generally cylindrical section extends below the first flange 370 of the wellhead isolation tool. The generally cylindrical section has a first lower section 374 having an outer surface diameter equal or slightly smaller than the inner surface diameter of the first inner surface section of the body member of the tubing head assembly. A second section 376 of the wellhead isolation tool cylindrical section extending above the first lower section 374 has an outer surface diameter slightly smaller than the inner surface diameter of the second section 365 of the body member 350 and greater than the outer surface diameter of the first lower section 374. Consequently, an annular shoulder 371 is defined between the two outer surface sections of the wellhead isolation tool cylindrical section. The well head isolation tool is fitted within the cylindrical opening of the body member of the tubing head assembly such that the flange 370 of the wellhead isolation tool mates with the flange 360 of the body member 350. When that occurs, the annular shoulder 371 defined between the two outer surface sections of the cylindrical section of the wellhead isolation tool mates with the portion of the first section inner surface 363 of the body member 350.

Prior to installing the mandrel casing hanger into the casing head, a spring loaded latch ring 380 is fitted in the outer groove 326 of the mandrel casing hanger. The spring loaded latch ring has a generally upside down "T" shape in cross section comprising a vertical portion 382 and a first horizontal portion 384 for sliding into the outer annular groove 326 formed on the mandrel casing hanger. A second horizontal portion 386 extends from the other side of the vertical portion opposite the first horizontal portion.

The spring loaded latch ring is mounted on the mandrel casing hanger such that its first horizontal portion 384 is fitted into the external groove 326 formed in the mandrel casing hanger. The spring loaded latch ring biases against the outer surface of the mandrel casing hanger. When fitted into the external annular groove 326 formed in the mandrel casing hanger, the outer most surface of the second horizontal portion 386 of the latch ring has a diameter no greater than the diameter of the first outer surface section 312 of the mandrel casing hanger. In this regard, the mandrel casing hanger with the spring loaded latch ring can be slipped into the casing head so that the tapering outer surface 310 of the mandrel casing hanger can sit on the tapering inner surface portion 308 of the casing head.

In the exemplary embodiment, once the mandrel casing hanger is seated onto the casing head, the body member 350 of the tubing head assembly is fitted within the casing head such that the lower section of the outer surface of the body member threads on the third section inner surface of the mandrel casing hanger such that the protrusion 356 formed on the outer surface of the body member is mated within the counterbore 343 formed on the upper end of the third section inner surface of the mandrel casing hanger. The wellhead isolation tool is then fitted with its cylindrical section within the body member 350 such that the flange 370 of the wellhead isolation tool mates with the flange 360 of the body member. When this occurs, the annular shoulder 371 formed on the cylindrical section of the wellhead isolation tool mates with the first section 363 of the inner surface of the body member 350. Similarly, the lower outer surface section of the cylindrical section of the wellhead isolation tool mates with the inner surface second section 334 of the mandrel casing hanger. Seals 388 are provided in grooves formed 390 on the outer surface of the lower section of the cylindrical section of the wellhead isolation tool to mate with the second section inner surface of the mandrel casing hanger. In the alternative, the seals may be positioned in grooves formed on the second section inner surface of the mandrel casing hanger. In the exemplary embodiment, the seals are self-energizing seals, as for example, O-ring, T-seal or S-seal type seals.

A top nut 392 is fitted between the mandrel casing hanger upper end portion and the upper end of the casing head. More specifically, the top nut has a generally cylindrical inner surface section having a first diameter portion 394 above which extends a second portion 396 having a diameter greater than the diameter of the first portion. The outer surface 398 of the top nut has four sections. A first section 400 extending from the lower end of the top nut having a first diameter. A second section 402 extending above the first section having a second diameter greater than the first diameter. A third section 404 extending from the second section having a third diameter greater than the second diameter. And a fourth section 406 extending from the third section having a fourth diameter greater than the third diameter and greater than the inner surface diameter of the upper end of the mandrel casing hanger. Threads 408 are formed on the outer surface of the second section 402 of the top nut for threading onto the internal threads 328 formed on the inner surface of the upper end of the mandrel casing head. The top nut first and second outer surface sections are aligned with the first inner surface section of the top nut. In this regard, a leg 410 is defined extending at the lower end of the top nut.

The top nut is threaded on the inner surface of the casing head. As the top nut moves down on the casing head, the leg 410 of the top nut engages the vertical portion 382 of the spring loaded latch ring, moving the spring loaded latch ring radially outwards against the latch ring spring force such that the second horizontal portion 386 of the latch ring slides into the groove 330 formed on the inner surface of the casing head while the first horizontal portion remains within the groove 326 formed on the outer surface of the mandrel casing head. In this regard, the spring loaded latch ring along with the top nut retain the mandrel casing hanger within the casing head.

A seal 412 is formed on the third outer surface section of the top nut for sealing against the casing head. In the alternative the seal may be formed on the casing head for sealing against the third section of the top nut. A seal 414 is also formed on the second section inner surface of the top nut for sealing against the outer surface of the mandrel casing hanger. In the alternative, the seal may be formed on the outer surface of the casing hanger for sealing against the second section of the inner surface of the top nut.

To check the seal between the outer surface of the lower section of the cylindrical section of the wellhead isolation tool and the inner surface of the mandrel casing hanger, a port 416 is defined radially through the flange 370 of the wellhead isolation tool. The port provides access to a passage 415 having a first portion 417 radially extending through the flange 370, a second portion 418 extending axially along the cylindrical section of the wellhead isolation tool, and a third portion 419 extending radially outward to a location between the seals 388 formed between the lower section of the wellhead isolation tool and the mandrel casing hanger. Pressure, such as air pressure, may be applied to port 416 to test the integrity of the seals 388. After testing the port 416 is plugged with a pipe plug 413.

With any of the aforementioned exemplary embodiment wellhead isolation tools, a passage such as the passage 415 shown in FIG. 7A, may be provided through the body of the wellhead isolation to allow for testing the seals or between the seals at the lower end of the wellhead isolation tool from a location on the wellhead isolation tool remote from such seals.

The upper assembly is secured on the wellhead isolation tool using methods well known in the art such as bolts and nuts. Similarly, an exemplary embodiment wellhead isolation tool is mounted on the tubing head assembly using bolts 409 and nuts 411.

Figure 8:
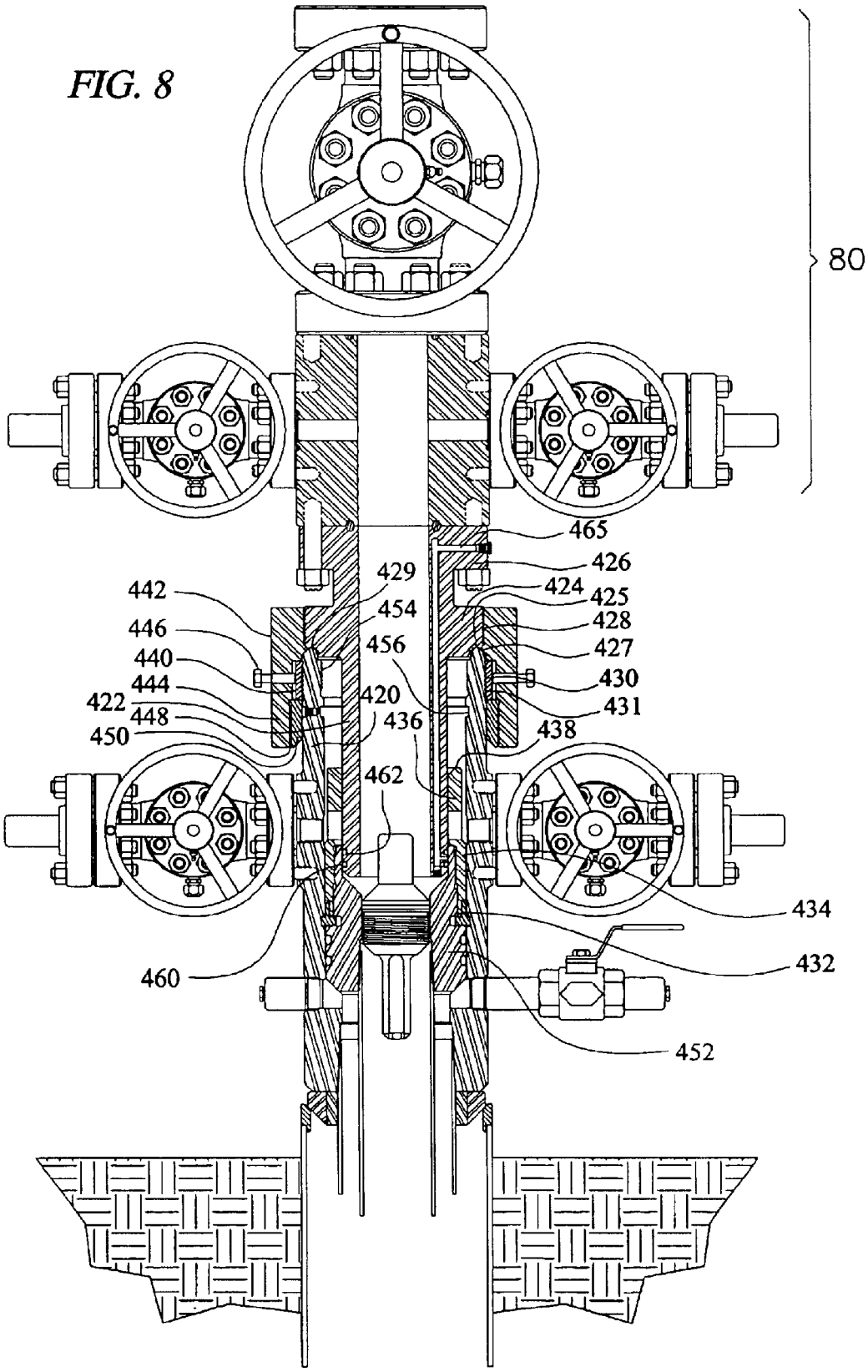
FIG. 8 is a partial cross-sectional view of another exemplary embodiment wellhead incorporating another exemplary embodiment wellhead isolation tool of the present invention.

In another exemplary embodiment assembly of the present invention shown in FIG. 8, a combination tubing head/casing head body member 420 is used instead of a separate tubing head and casing head. Alternatively, an elongated tubing head body member coupled to a casing head may be used. In the exemplary embodiment shown in FIG. 8, the body member is coupled to the wellhead. A wellhead isolation tool 422 used with this embodiment comprises an intermediate flange 424 located below a flange 426 interfacing with the upper assembly 80. An annular step 425 is formed on the lower outer periphery of the intermediate flange. When the wellhead isolation tool 422 is fitted in the body member 420, the annular step 425 formed on the intermediate flange seats on an end surface 427 of the body member. A seal 429 is fitted in a groove formed on the annular step seals against the body member 420. Alternatively the groove accommodating the seal may be formed on the body member 420 for sealing against the annular step 425. Outer threads 428 are formed on the outer surface of the intermediate flange 424. When fitted into the body member 420, the intermediate flange 424 sits on an end portion of the body member 420. External grooves 430 are formed on the outer surface near an upper end of the body member defining wickers. In an alternate embodiment threads may be formed on the outer surface near the upper end of the body member.

With this exemplary embodiment, a mandrel casing hanger 452 is mated and locked against the body member 420 using a spring loaded latch ring 432 in combination with a top nut 434 in the same manner as described in relation to the exemplary embodiment shown in FIGS. 7A and 7B. However, the top nut 434 has an extended portion 436 defining an upper surface 438 allowing for the landing of additional wellhead structure as necessary. For example, another hanger (not shown) may be landed on the upper surface 438. In another exemplary embodiment, internal threads 454 are formed on the inner surface of the body member to thread with external threads formed in a second top nut which along with a spring latch ring that is accommodated in groove 456 formed on the inner surface of the body member 420 can secure any additional wellhead structure such as second mandrel seated on the top of the extended portion of top nut 434.

Once the wellhead isolation tool 422 is seated on the body member 420, a segmented lock ring 440 is mated with the wickers 430 formed on the outer surface of the body member. Complementary wickers 431 are formed on the inner surface of the segmented lock ring and intermesh with the wickers 430 on the outer surface of the body member. In an alternate embodiment, the segmented lock ring may be threaded to a thread formed on the outer surface of the body member. An annular nut 442 is then threaded on the threads 428 formed on the outer surface of the intermediate flange 424 of the wellhead isolation tool. The annular flange has a portion 444 that extends over and surrounds the segmented lock ring. Fasteners 446 are threaded through the annular nut and apply pressure against the segmented locking ring 440 locking the portion of the annular nut relative to the segmented lock ring.

An internal thread 448 is formed on the lower inner surface of the annular nut 442. A lock nut 450 is threaded onto the internal thread 448 of the annular nut and is sandwiched between the body member 420 and the annular nut 442. In the exemplary embodiment shown in FIG. 8, the lock nut 450 is threaded until it engages the segmented locking ring 440. Consequently, the wellhead isolation tool 422 is retained in place seated on the body member 420.

Seals 460 are formed between a lower portion of the wellhead isolation tool 422 and an inner surface of the hanger 452. This is accomplished by fitting seals 460 in grooves 462 formed on the outer surface of the wellhead isolation tool 422 for sealing against the inner surface of hanger 452. Alternatively the seals may be fitted in grooves formed on the inner surface of the hanger 452 for sealing against the outer surface of the wellhead isolation tool. To check the seal between the outer surface of the wellhead isolation tool 422 and the inner surface of the hanger 452, a port 465 is defined through the flange 426 of the wellhead isolation tool and down along the well head isolation tool to a location between the seals 460 formed between the wellhead isolation tool and the hanger 452.

The inner surface of the mandrel casing hanger has three major sections. A first inner surface section 332 at the lower end which may be a tapering surface, as for example shown in FIG. 7B. A second inner surface 334 extends from the first inner surface section 332. In the exemplary embodiment shown in FIG. 7B, a tapering annular surface 336 adjoins the first inner surface to the second major inner surface. A third inner surface 338 extends from the second inner surface. An annular tapering surface 340 adjoins the third inner surface to the second inner surface. An upper end 342 of the third inner surface of the mandrel casing hanger increases in diameter forming a counterbore 343 and a tapered thread 344.

With any of the aforementioned embodiment, one or more seals may be used to provide the appropriate sealing. Moreover, any of the aforementioned embodiment wellhead isolation tools and assemblies provide advantages in that they isolate the wellhead or tubing head body from pressures of refraction in process while at the same time allowing the use of a valve instead of a BOP when forming the upper assembly 80. In addition, by providing a seal at the bottom portion of the wellhead isolation tool, each of the wellhead isolation exemplary embodiment tools of the present invention isolate the higher pressures to the lower sections of the tubing head or tubing head/casing head combination which tend to be heavier sections and can better withstand the pressure loads. Furthermore, they allow for multiple fracturing processes and allow the wellhead isolation tool to be used in multiple wells without having to use a BOP between fracturing processes from wellhead to wellhead. Consequently, multiple BOPs are not required when fracturing multiple wells.

The wellhead isolation tools of the present invention as well as the wellhead assemblies used in combination with the wellhead tools of the present invention including, among other things, the tubing heads and casing heads may be formed from steel, steel alloys and/or stainless steel. These parts may be formed by various well known methods such as casting, forging and/or machining.

While the present invention will be described in connection with the depicted exemplary embodiments, it will be understood that such description is not intended to limit the invention only to those embodiments, since changes and modifications may be made therein which are within the full intended scope of this invention as hereinafter claimed.

What is claimed is:

1. A wellhead assembly comprising:

a casing;

a first tubular member mounted over the casing;

a first tubular member flange extending from the first tubular member;

a generally elongate annular member suspended in the first tubular member, said annular member having a first end portion extending above the first tubular member and a second end portion below the first end portion;

a secondary flange extending from the elongate annular member;

a plurality of fasteners fastening the secondary flange to the first tubular member flange; and a production tubular member aligned with the elongate annular member, wherein an axial force acts on the generally elongate annular member and is reacted in both the first tubular member flange and the secondary flange.

2. A wellhead assembly as recited in claim 1 wherein the first tubular member comprises an inner surface having an annular lip, wherein said annular lip extends between the elongate annular member second end portion and a portion of the production tubular member.

3. A wellhead assembly as recited in claim 2 wherein said annular lip extends radially inward defining an opening having a first diameter, wherein the elongate annular member first end portion comprises an inner surface having a second diameter and wherein the portion of the production tubular member comprises an inner surface having a third diameter, wherein said first, second and third diameters are equal.

4. A wellhead assembly as recited in claim 1 further comprising a seal between the elongate annular member second end portion and the first tubular member.

5. A wellhead assembly as recited in claim 4 wherein the seal is between the elongate annular member second end portion and a first inner surface section of the first tubular member, wherein the first tubular member comprises a second inner surface section immediately above and concentric with the first inner surface section, said second inner surface section having a diameter greater than the first inner surface section.

6. A wellhead assembly as recited in claim 4 further comprising a second seal between the elongate annular member second end portion and the first tubular member.

7. A wellhead assembly as recited in claim 6 wherein the seals are self energizing seals.

8. A wellhead assembly as recited in claim 6 further comprising a port through the first tubular member providing access to the elongate annular member at a location between the seals.

9. A wellhead assembly as recited in claim 6 further comprising a passage through the elongate annular member providing access to an inner surface of the elongate annular member at a location between the seals from a remote location on the outer surface of the elongate annular member.

10. A wellhead assembly as recited in claim 4 further comprising a fracturing tree mounted over the generally elongate annular member.

11. A wellhead assembly as recited in claim 4 further comprising a BOP mounted over the generally elongate annular member.

12. A wellhead assembly as recited in claim 4 wherein the secondary flange is separate from the elongate annular member.

13. A wellhead assembly as recited in claim 12 further comprising:

at least one lower depression formed on the elongate annular member outer surface;

at least one upper depression formed on the elongate annular member outer surface above the lower depression;

a first plurality lock screws each radially threaded through the first tubular member flange and engaging the at least one lower depression; and a second plurality of lock screws each radially threaded through the secondary flange and engaging the at least one upper depression, wherein the secondary flange is fastened to the first tubular member flange.

14. A wellhead assembly as recited in claim 13 wherein the elongate annular member comprises an outer surface portion between the first and second ends and below the at least one lower depression, said outer surface portion tapering from a larger diameter to a smaller diameter in a direction toward the second end, wherein the first tubular member comprises a tapering inner surface portion complementary to the inner tapering outer surface portion of the elongate annular member, and wherein the outer tapering surface portion of the elongate annular member seats against the tapering inner surface portion of the first tubular member.

15. A wellhead assembly as recited in claim 14 further comprising a seal between the outer tapering surface portion of the elongate annular member and the tapering inner surface portion of the first tubular member.

16. A wellhead assembly as recited in claim 12 further comprising a plurality lock screws each radially threaded through the first tubular member flange and engaging at least a depression formed on the elongate annular member outer surface, wherein the elongate annular member further comprises a threaded outer surface portion, and wherein the secondary flange is an annular, flange threaded on the elongate annular member threaded outer surface portion.

17. A wellhead assembly as recited in claim 16 wherein the elongate annular member comprises an intermediate flange, and wherein the elongate annular member threaded outer surface portion is formed on the outer surface of the intermediate flange.

18. A wellhead assembly as recited in claim 4 wherein the elongate annular member comprises an outer surface portion between the first and second ends, wherein the first tubular member comprises a tapering inner surface portion tapering from a larger diameter section to smaller diameter section in a direction toward the casing, wherein when suspended in the first tubular member, a portion of a section of the outer surface of the elongate annular member mates with the smaller diameter inner surface section of the first tubular member and a portion of the section of the outer surface of the elongate annular member is surrounded by the tapering inner surface portion of the first tubular member defining a gap between said tapering inner surface portion and said portion of the section of the outer surface of the elongate annular member surrounded by said tapering inner surface portion, and wherein said portion of the section of the outer surface of the elongate annular member is located below said first tubular member flange when said elongate annular member is suspended in said first tubular member flange.

19. A wellhead assembly as recited in claim 4 further comprising:

a plurality lock screws each radially threaded through the first tubular member flange and engaging at least a depression formed on the elongate annular member outer surface, wherein the elongate annular member flange is fastened to the first tubular member flange.

20. A wellhead assembly as recited in claim 1 wherein the elongate annular member comprises an outer surface portion between the first and second ends tapering form a larger diameter to a smaller diameter in a direction toward the second end, wherein the first tubular member comprises a tapering inner surface portion complementary to the inner tapering outer surface portion of the elongate annular member, and wherein the outer tapering surface portion of the elongate annular member seats against the tapering inner surface portion of the first tubular member.

21. A wellhead assembly as recited in claim 20 further comprising a seal between the outer tapering surface portion of the elongate annular member and the tapering inner surface portion of the first tubular member.

22. A wellhead assembly as recited in claim 1 wherein the elongate annular member comprises an outer surface portion between the first and second ends, wherein the first tubular member comprises a tapering inner surface portion tapering from a larger diameter section to smaller diameter section in a direction toward the casing, wherein when suspended in the first tubular member, a portion of a section of the outer surface of the elongate annular member mates with the smaller diameter inner surface section of the first tubular member and a portion of the section of the outer surface of the elongate annular member is surrounded by the tapering inner surface portion of the first tubular member defining a gap between said tapering inner surface portion and said portion of the section of the outer surface of the elongate annular member surrounded by said tapering inner surface portion.

23. A wellhead assembly as recited in claim 1 wherein a portion of the first tubular member extends within a casing head coupled to the casing, the wellhead assembly further comprising:

an annular hanger suspended in the first tubular member, wherein an annular gap is defined between an outer surface of the first tubular member and an inner surface of the casing head, wherein said annular hanger has a first inner surface section and a second inner surface section below the first inner surface section, wherein the second inner surface section has a diameter smaller than the first inner surface section, and wherein the second end portion of the elongate annular member extends to the first inner surface section of the annular hanger;

a first annular groove formed on the outer surface of the hanger and aligned with a second annular groove formed on the inner surface of the first tubular member when the hanger is suspended in the first tubular member, wherein the annular gap extends to said aligned grooves;

a spring loaded latch, wherein in cross-section the spring loaded latch comprises a first section extending opposite a second section and a third section extending from and transvesely to said first and second sections and fitted within the annular gap, wherein the latch can move from a first position where at least a portion of the first section of the latch is within the first annular groove and at least a portion of the second section of the latch is within the second annular groove to a second position where the first section of the latch is not within the first annular groove and at least a portion of the second section of the latch is within the second annular groove, wherein the latch is spring loaded to the second position; and a top nut having an first section, and a second section extending below the first section wherein the first section comprises an outer surface having a diameter greater than an outer surface of the top nut second section, and wherein the top nut is fitted within the annular gap causing the top nut second section to engage the third section of the spring latch and move the spring latch to the first position.

24. A wellhead assembly as recited in claim 23 wherein the top nut further comprises third section extending above the first section and surrounding the elongate annular member, said top nut third section having an end surface providing a landing for other wellhead equipment.

25. A wellhead assembly as recited in claim 23 wherein the top nut first section is threaded on the outer surface of the hanger.

26. A wellhead assembly as recited in claim 25 wherein the annular hanger is sandwiched between the top nut first section and the, elongate annular member.

27. A wellhead assembly as recited in claim 23 further comprising a seal between the second end portion of the elongate annular member and the first inner surface section of the annular hanger.

28. A wellhead assembly as recited in claim 1 wherein the first tubular member is a tubing head.

29. A wellhead assembly as recited in claim 1 wherein an end of the elongate annular member is aligned with and faces an end of the production tubular member, wherein an inner surface diameter of said end of said elongate annular member is about equal to an inner surface diameter of said end of said production tubular member.

30. A wellhead assembly as recited in claim 1 wherein the first tubular member flange and the secondary flange are fastened together.

31. A wellhead assembly as recited in claim 1 further comprising:

at least one lower depression formed on the elongate annular member outer surface;

at least one upper depression formed on the elongate annular member outer surface above the lower depression;

a first plurality lock screws each radially threaded through the first tubular member flange and engaging the at least one lower depression; and a second plurality of lock screws each radially threaded through the secondary flange and engaging the at least one upper depression and coupling the secondary flange to the generally elongate annular member, wherein the secondary flange is fastened to the first tubular member flange, and wherein the secondary flange is separate from the generally elongate annular member.

32. A wellhead assembly as recited in claim 1 further comprising a first plurality lock screws each radially threaded through one of said first tubular member flange and secondary flange and engaging the generally elongate annular member, wherein the other of said first tubular member flange and secondary flange is threaded on the generally elongate annular member, wherein the secondary flange is fastened to the first tubular member flange, and wherein the secondary flange is separate from the generally elongate annular member.

33. A wellhead assembly as recited in claim 32 wherein the lock screws are threaded through the first tubular member flange and wherein the secondary flange is threaded on the generally elongate annular member.

34. A wellhead assembly as recited in claim 1 further comprising a third flange extending from the generally elongate annular member spaced apart from the secondary flange.

35. A wellhead assembly as recited in claim 1 wherein the generally elongate annular member second end is located within the first tubular member.

36. A wellhead assembly as recited in claim 1 wherein the secondary flange is separate from the generally elongate member.

37. A wellhead assembly comprising:

a casing;

a first tubular member mounted over the casing, the first tubular member comprising a flange and a tapering inner surface portion tapering from a larger diameter section to a smaller diameter section in a direction toward the casing;

a generally elongate annular member suspended in the first tubular member, said annular member having a first end portion extending above the first tubular member and a second end portion below the first end portion within the first tubular member, wherein the elongate annular member comprises an outer surface portion between the first and second ends, wherein a portion of a section of the outer surface of the elongate annular member mates with the smaller diameter inner surface section of the first tubular member and a portion of the section of the outer surface of the elongate annular member is surrounded by the tapering inner surface portion of the first tubular member defining a gap between said tapering inner surface portion and said portion of the section of the outer surface of the elongate annular member surrounded by said tapering inner surface portion, and wherein said portion of the section of the outer surface of the elongate annular member is located below said first tubular member flange when said elongate annular member is suspended in said first tubular member flange;

a second flange extending from the generally elongate annular member; and a production tubular member aligned with the elongate annular member, wherein an axial force acts on the generally elongate annular member and is reacted in both the first tubular member flange and the second flange.

38. A wellhead assembly as recited in claim 37 further comprising:

a plurality lock screws each radially threaded through the first tubular member flange and engaging at least a depression formed on the elongate annular member outer surface, wherein the elongate annular member flange is fastened to the first tubular member flange.

39. A wellhead assembly as recited in claim 37 further comprising a seal between the elongate annular member second end portion and the first tubular member.

40. A wellhead assembly as recited in claim 39 further comprising a second seal between the elongate annular member second end portion and the first tubular member.

41. A wellhead assembly as recited in claim 40 wherein the seals are self energizing seals.

42. A wellhead assembly as recited in claim 40 further comprising a port through the first tubular member providing access to the elongate annular member at a location between the seals.

43. A wellhead assembly as recited in claim 40 further comprising a passage through the elongate annular member providing access to an inner surface of the elongate annular member at location between the seals from a remote location on the outer surface of the elongate annular member.

44. A wellhead assembly as recited in claim 37 wherein the first tubular member is a tubing head.

45. A wellhead assembly as recited in claim 37 wherein an end of the elongate annular member is aligned with and faces an end of the production tubular member, wherein an inner surface diameter of said end of said elongate annular member is about equal to an inner surface diameter of said end of said production tubular member.

46. A wellhead assembly as recited in claim 37 wherein the first tubular member flange and the second flange are fastened together.

47. A wellhead assembly as recited in claim 37 further comprising:

at least one lower depression formed on the elongate annular member outer surface;

at least one upper depression formed on the elongate annular member outer surface above the lower depression;

a first plurality lock screws each radially threaded through the first tubular member flange and engaging the at least one lower depression; and a second plurality of lock screws each radially threaded through the second flange and engaging the at least one upper depression and coupling the secondary flange to the generally elongate annular member, wherein the second flange is fastened to the first tubular member flange, and wherein the second flange is separate from the generally elongate annular member.

48. A wellhead assembly as recited in claim 37 further comprising a first plurality lock screws each radially threaded through one of said first tubular member flange and second flange and engaging the generally elongate annular member, wherein the other of said first tubular member flange and second flange is threaded on the generally elongate annular member, wherein the second flange is fastened to the first tubular member flange, and wherein the second flange is separate from the generally elongate annular member.

49. A wellhead assembly as recited in claim 48 wherein the lock screws are threaded through the first tubular member flange and wherein the second flange is threaded on the generally elongate annular member.

50. A wellhead assembly as recited in claim 37 further comprising a third flange extending from the generally elongate annular member spaced apart from the second flange.

51. A wellhead assembly as recited in claim 37 wherein the second flange is separate from the generally elongate annular member.

52. A wellhead assembly comprising:

a casing;

a first tubular member mounted over the casing;

a generally elongate annular member suspended in the first tubular member, said annular member having a first end portion extending above the first tubular member and a second end portion below the first end portion within the first tubular member;

a production tubular member aligned with the elongate annular member;

an annular nut coupled to the elongate annular member and surrounding an upper end of the first tubular member;

a locking ring coupled to the first tubular member and surrounded by the annular nut; and a lock nut coupled to the annular nut at a location below the locking ring, wherein the lock nut has an inner surface having a diameter and wherein the locking ring has an outer surface having a diameter wherein the diameter of the of the lock nut inner surface is smaller than the diameter of the locking ring outer surface.

53. A wellhead assembly as recited in claim 52 further comprising a seal between the elongate annular member second end portion and the first tubular member.

54. A wellhead assembly as recited in claim 53 wherein the elongate annular member comprises a flange and wherein the annular nut is threaded on the elongate annular member flange.

55. A wellhead assembly as recited in claim 54 wherein an annular shoulder is formed on the elongate annular member flange accommodating an end portion of the first tubular member.

56. A wellhead assembly as recited in claim 54 wherein the lock nut is threaded to the inner surface of the annular nut.

57. A wellhead assembly as recited in claim 52 wherein the locking ring is a segmented ring having wickers on an inner surface interfacing with wickers formed on the first tubular member.

58. A wellhead assembly as recited in claim 57 further comprising a plurality of push screws radially threaded though the annular nut and engaging the outer surface of the locking ring for urging the locking ring against the first tubular member.

59. A wellhead assembly as recited in claim 52 wherein a portion of the first tubular member extends within a casing head coupled to the casing, the wellhead assembly further comprising:

an annular hanger suspended in the casing head, wherein an annular gap is defined between an outer surface of the hanger and an inner surface of the casing head, wherein said annular hanger comprises an inner surface having an upper inner surface section, an intermediate inner surface section below the upper inner surface section and a lower inner surface section below the intermediate inner surface section, wherein the intermediate inner surface section has a diameter smaller than the upper inner surface section, and wherein the lower inner surface section has a diameter smaller than the intermediate inner surface section, wherein the first tubular member comprises a lower section within the upper inner surface section of the annular hanger and wherein the second end portion of the elongate annular member extends to the intermediate inner surface section of the annular hanger sandwiching a portion of the first tubular member lower section between the outer surface of the elongate annular member and the upper inner surface of the annular hanger;

a first annular groove formed on the outer surface of the hanger and aligned with a second annular groove formed on the inner surface of the casing head when the hanger is suspended in the casing head, wherein the annular gap extends to said aligned grooves;

a spring loaded latch, wherein in cross-section the spring loaded latch comprises a first section extending opposite a second section and a third section extending from and transvesely to said first and second sections and fitted within the annular gap, wherein the latch can move from a first position where at least a portion of the first section of the latch is within the first annular groove and at least a portion of the second section of the latch is within the second annular groove to a second position where the first section of the latch is not within the first annular groove and at least a portion of the second section of the latch is within the second annular groove, wherein the latch is spring loaded to the second position; and a top nut having an upper section and a lower section wherein the upper section comprises an outer surface having a diameter greater than an outer surface of the top nut lower section, and wherein the top nut is fitted within the annular gap causing the top nut lower section to engage the third section of the spring latch and move the spring latch to the first position.

60. A wellhead assembly as recited in claim 59 wherein the top nut upper section is threaded on the inner surface of casing head.

61. A wellhead assembly as recited in claim 60 wherein annular hanger is sandwiched between the top nut upper section and the elongate annular member.

62. A wellhead assembly as recited in claim 59 further comprising a seal between the elongate annular member second end portion and the intermediate inner surface section of the annular hanger.

63. A wellhead assembly as recited in claim 62 further comprising:

a second seal between the elongate annular member second end portion and the inner surface of the annular hanger; and an access path from an outer surface portion of the elongate annular member to an inner surface of the elongate annular member between the two seals.

64. A wellhead assembly as recited in claim 63 wherein the two seals are self energizing seals.

65. A wellhead assembly as recited in claim 52 wherein the first tubular member is a tubing head.

66. A wellhead assembly as recited in claim 52 wherein an end of the elongate annular member is aligned with and faces an end of the production tubular member, wherein an inner surface diameter of said end of said elongate annular member is about equal to an inner surface diameter of said end of said production tubular member.

67. A wellhead assembly comprising:

an annular head;

a generally elongate annular member suspended in the head, said annular member having an upper end portion extending above the head and a lower end portion within the head;

a production tubular member aligned with the elongate annular member;

an annular nut coupled to the elongate annular member and surrounding an upper end of the head;

a locking ring coupled to the head and surrounded by the annular nut; and a lock nut coupled to the annular nut at a location below the locking ring, wherein the lock nut has an inner surface having a diameter and wherein the locking ring has an outer surface having a diameter wherein the diameter of the of the lock nut inner surface is smaller than the diameter of the locking ring outer surface.

68. A wellhead assembly as recited in claim 67 further comprising:

an annular hanger suspended in the head below the upper end of the head, wherein an annular gap is defined between an outer surface of the annular hanger and an inner surface of the head, wherein said annular hanger has an upper inner surface section and a lower inner surface section below the upper inner surface section, wherein the lower inner surface section has a diameter smaller than the upper inner surface section, and wherein the second end portion of the elongate annular member extends to the upper inner surface section of the annular hanger;

a first annular groove formed on the outer surface of the hanger and aligned with a second annular groove formed on the inner surface of the head when the hanger is suspended in the head, wherein the annular gap extends to said aligned grooves;

a spring loaded latch, wherein in cross-section the spring loaded latch comprises a first section extending opposite a second section and a third section extending from and transversely to said first and second sections and fitted within the annular gap, wherein the latch can move from a first position where at least a portion of the first section of the latch is within the first annular groove and at least a portion of the second section of the latch is within the second annular groove to a second position where the first section of the latch is not within the first annular groove and at least a portion of the second section of the latch is within the second annular groove, wherein the latch is spring loaded to the second position; and a top nut having an first section and a second section extending below the first section wherein the first section comprises an outer surface having a diameter greater than an outer surface of the top nut second section, and wherein the top nut is fitted within the annular gap causing the top nut second section to engage the third section of the spring latch and move the spring latch to the first position.

69. A wellhead assembly as recited in claim 68 wherein the top nut further comprises third section extending above the first section and surrounding the elongate annular member, said top nut third section having an end surface providing a landing for other wellhead equipment.

70. A wellhead assembly as recited in claim 68 wherein the top nut first section is threaded on the outer surface of the hanger.

71. A wellhead assembly as recited in claim 70 wherein at least a portion of the annular hanger is sandwiched between the top nut first section and the elongate annular member.

72. A wellhead assembly as recited in claim 68 further comprising a seal between the second end portion of the elongate annular member and the annular hanger.

73. A wellhead assembly as recited in claim 72 further comprising:

a second seal between the elongate annular member second end portion and the annular hanger; and an access path from an outer surface portion of the elongate annular member to an inner surface of the elongate annular member between the two seals.

74. A wellhead assembly as recited in claim 73 wherein the two seals are self energizing seals.

75. A wellhead assembly as recited in claim 67 wherein the head comprises a tubing head mounted over a casing head.

76. A wellhead assembly as recited in claim 67 wherein an end of the elongate annular member is aligned with and faces an end of the production tubular member, wherein an inner surface diameter of said end of said elongate annular member is about equal to an inner surface diameter of said end of said production tubular member.

77. A wellhead assembly comprising:

wellhead member;

a first tubular member mounted over the wellhead member;

a first flange extending from the first tubular member;

a generally elongate annular member suspended in the first tubular member;

a second flange extending from the generally elongate annular member;

a production tubular member aligned with the elongate annular member, wherein an end of the elongate annular member is aligned with the production tubular member, wherein an axial force acts on the generally elongate annular member and is reacted in both the first and second flanges; and a plurality lock screws each radially threaded through one of said first flange and second flange and engaging the generally elongate annular member, wherein the other of said first flange and second flange is threaded on the generally elongate annular member, wherein the second flange is fastened to the first flange, and wherein the second flange is separate from the generally elongate annular member.

78. A wellhead assembly as recited in claim 77 wherein the inner surface diameter of said end of said elongate annular member is equal to the inner surface diameter of said end of said production tubular member.

79. A wellhead assembly as recited in claim 77 wherein the wellhead member is a casing head.

80. A wellhead assembly as recited in claim 77 wherein the elongate annular member is a frac mandrel.

81. A wellhead assembly as recited in claim 77 wherein the first and second flanges are fastened together.

82. A wellhead assembly as recited in claim 77 further comprising a third flange extending from the generally elongate annular member spaced apart from the second flange.

83. A wellhead assembly comprising:

a casing;

a first tubular member mounted over the casing;

a first tubular member flange extending from the first tubular member;

a generally elongate annular member suspended in the first tubular member, said annular member having a first end portion extending above the first tubular member and a second end portion below the first end portion within the first tubular member;

a secondary flange extending from the elongate annular member;

a plurality of fasteners fastening the secondary flange to the first tubular member flange;

a production tubular member aligned with the elongate annular member;

a first seal between the elongate annular member second end portion and the first tubular member;

at least one lower depression formed on the elongate annular member outer surface;

at least one upper depression formed on the elongate annular member outer surface above the lower depression;

a first plurality lock screws each radially threaded through the first tubular member flange and engaging the at least one lower depression;

a second plurality of lock screws each radially threaded through the secondary flange and engaging the at least one upper depression, wherein the secondary flange is fastened to the first tubular member flange, and wherein the secondary flange is separate from the elongate annular member; and a second seal between the outer tapering surface portion of the elongate annular member and the tapering inner surface portion of the first tubular member, wherein the elongate annular member comprises an outer surface portion between the first and second ends and below the at least one lower depression, said outer surface portion tapering from a larger diameter to a smaller diameter in a direction toward the second end, wherein the first tubular member comprises a tapering inner surface portion complementary to the inner tapering outer surface portion of the elongate annular member, and wherein the outer tapering surface portion of the elongate annular member seats against the tapering inner surface portion of the first tubular member.

84. A wellhead assembly comprising:

a casing;

a first tubular member mounted over the casing;

a first tubular member flange extending from the first tubular member;

a generally elongate annular member suspended in the first tubular member, said annular member having a first end portion extending above the first tubular member and a second end portion below the first end portion within the first tubular member, said elongate annular member further comprising a threaded outer surface portion;

a secondary annular flange threaded on the elongate annular member threaded outer surface portion a secondary annular flange threaded on the elongate annular member threaded outer portion, wherein the secondary annular flange is separate from the elongate annular member;

a plurality of fasteners fastening the secondary flange to the first tubular member flange;

a production tubular member aligned with the elongate annular member;

a seal between the elongate annular member second end portion and the first tubular member; and a plurality lock screws each radially threaded through the first tubular member flange and engaging at least a depression formed on the elongate annular member outer surface.

85. A wellhead assembly as recited in claim 84 wherein the elongate annular member comprises an intermediate flange, and wherein the elongate annular member threaded outer surface portion is formed on the outer surface of the intermediate flange.

86. A wellhead assembly comprising:

wellhead member;

a first tubular member mounted over the wellhead member;

a first flange extending from the first tubular member;

a generally elongate annular member suspended in the first tubular member;

a second flange extending from the generally elongate annular member;

a production tubular member aligned with the elongate annular member, wherein an end of the elongate annular member is aligned with the production tubular member, wherein an axial force acts on the generally elongate annular member and is reacted in both the first and second flanges;

at least one lower depression formed on the elongate annular member outer surface;

at least one upper depression formed on the elongate annular member outer surface above the lower depression;

a first plurality lock screws each radially threaded through the first flange and engaging the at least one lower depression; and a second plurality of lock screws each radially threaded through the second flange and engaging the at least one upper depression and coupling the secondary flange to the generally elongate annular member, wherein the second flange is fastened to the first flange, and wherein the second flange is separate from the generally elongate annular member.

87. A wellhead assembly as recited in claim 86 wherein the lock screws are threaded through the first flange and wherein the second flange is threaded on the generally elongate annular member.

88. A wellhead assembly as recited in claim 86 further comprising a third flange extending from the generally elongate annular member spaced apart from the second flange.

* * * * *